US006244257B1

(12) United States Patent
Hu

(10) Patent No.: US 6,244,257 B1
(45) Date of Patent: Jun. 12, 2001

(54) INTERNAL COMBUSTION ENGINE WITH COMBINED CAM AND ELECTRO-HYDRAULIC ENGINE VALVE CONTROL

(75) Inventor: Haoran Hu, Novi, MI (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/629,426

(22) Filed: Jul. 31, 2000

Related U.S. Application Data

(63) Continuation of application No. 09/196,316, filed on Nov. 20, 1998, now Pat. No. 6,125,828, which is a continuation-in-part of application No. 08/955,509, filed on Oct. 22, 1997, now Pat. No. 5,839,453, which is a continuation of application No. 08/772,781, filed on Dec. 24, 1996, now Pat. No. 5,680,841, which is a continuation of application No. 08/512,528, filed on Aug. 8, 1995, now abandoned.

(51) Int. Cl.[7] ..... F02M 25/06; F01L 13/06

(52) U.S. Cl. ..... 123/568.14; 123/90.12; 123/90.39; 123/90.46

(58) Field of Search ..... 123/568.14, 321, 123/322, 90.12, 90.16, 323, 90.6, 90.17, 90.39, 90.46

(56) References Cited

U.S. PATENT DOCUMENTS 4,473,047 * 9/1984 Jakuba et al. ..... 123/90.16
4,793,307 * 12/1988 Quenneville et al. ..... 123/90.12
5,000,145 * 3/1991 Quenneville ..... 123/321
5,036,810 * 8/1991 Meneely ..... 123/321
5,626,116 * 5/1997 Reedy et al. ..... 123/321
5,680,841 * 10/1997 Hu ..... 123/90.16
5,803,038 * 9/1998 Ihara et al. ..... 123/321
5,839,453 * 11/1998 Hu ..... 123/90.12
5,992,376 * 11/1999 Okada et al. ..... 123/321
6,000,374 * 12/1999 Cosma et al. ..... 123/321
6,125,828 * 10/2000 Hu ..... 123/568.14
6,152,104 * 11/2000 Vorih et al. ..... 123/568.14

* cited by examiner

*Primary Examiner*—Henry C. Yuen
*Assistant Examiner*—Hieu T. Vo
(74) *Attorney, Agent, or Firm*—David R. Yohannan; Collier Shannon Scott, PLLC

(57) ABSTRACT

An internal combustion engine has electrically controlled hydraulic linkages between engine cams and engine cylinder valves. If it is desired to skip a cam lobe or to modify the response of an engine cylinder valve to a cam lobe, hydraulic fluid is selectively released from the associated hydraulic linkage to permit lost motion between the cam and the engine cylinder valve. Electrically controlled hydraulic fluid valves are used to produce the selective release of hydraulic fluid from the hydraulic linkages. The mode of operation of the engine can be changed (e.g., from positive power mode to compression release engine braking mode or vice versa), or more subtle changes can be made to modify the timing and/or extent of engine cylinder valve openings to optimize engine performance for various engine or vehicle operating conditions (e.g., different engine or vehicle speeds). The valves can be controlled to produce an exhaust gas recirculation event during various operating modes of the engine.

22 Claims, 8 Drawing Sheets

0°
60°
120°
180°
240°
300°
360°
420°
480°
540°
600°
660°
720°

120

INTERNAL COMBUSTION ENGINE WITH COMBINED CAM AND ELECTRO-HYDRAULIC ENGINE VALVE CONTROL

CROSS REFERENCE TO RELATED APPLICATIONS

This application is a continuation of application Ser. No. 09/196,316, filed Nov. 20, 1998 and now U.S. Pat. No. 6,125,828, which is a continuation-in-part of U.S. patent application Ser. No. 08/955,509, filed Oct. 22, 1997 and now U.S. Pat. No. 5,839,453, which is a continuation of U.S. patent application Ser. No. 08/772,781, filed Dec. 24, 1996 and now U.S. Pat. No. 5,680,841, which is a continuation of U.S. patent application No. 08/512,528, filed Aug. 8, 1995, now abandoned.

FIELD OF THE INVENTION

This invention relates to internal combustion engines, and more particularly to internal combustion engines with valves that are opened by cams cooperating with hydraulic circuits to produce at least one of a main exhaust event, an engine regarding event and an exhaust gas recirculation event. The valves are partly controlled by electrically operated hydraulic fluid valves to modify the timing and duration of the events.

BACKGROUND OF THE INVENTION

In most internal combustion engines the engine cylinder intake and exhaust valves are opened and closed (at least for the most part) by cams in the engine. This makes it relatively difficult and perhaps impossible to adjust the timings and/or amounts of engine valve openings to optimize those openings for various engine operating conditions such as changes in engine speed.

It is known to include hydraulic lash adjusting mechanisms in the linkage between an engine cam and the engine cylinder valve controlled by that cam to make it possible to make relatively small adjustments in the valve strokes relative to the profile of the cam (see, for example, Rembold, et al., U.S. Pat. No. 5,113,812 and Schmidt et al., U.S. Pat. No. 5,325,825). These lash adjustments may be used to provide additional valve openings when it is desired to convert the engine from positive power mode to compression release engine braking mode (see, for example, Cartledge, U.S. Pat. No. 3,809,033 and Gobert et al., U.S. Pat. No. 5,145,890). Hydraulic circuitry may also be used to cause apart of the engine other than the cam which normally controls an engine valve to provide additional openings of the valve when it is desired to convert the engine from positive power mode to compression release engine braking mode (see, for example, Cummins, U.S. Pat. No. 3,220,392, and Hu, U.S. Pat. No. 5,379,737).

Schechter, U.S. Pat. No. 5,255,641, shows in FIG. 16 that an engine cam can be linked to an engine cylinder valve by a hydraulic circuit which includes a solenoid valve for selectively releasing hydraulic fluid from the hydraulic circuit. Schechter points out that various phases of the engine cylinder valve lift versus the cam curve can be obtained by varying the solenoid voltage pulse timing and duration. However, Schechter does not suggest that any lobe on the cam can be completely overridden in this way. It may not be possible to convert an engine from positive power mode to compression release engine braking mode and vice versa without the ability to selectively completely override any lobe on an engine cam.

Sickler, U.S. Pat. No. 4,572,114, shows internal combustion engine cylinder valve control which essentially uses two substantially separate hydraulic circuits for controlling the motion of each engine cylinder valve. One of these two hydraulic circuits controls selective decoupling of each engine cylinder valve from its normal cam-driven mechanical input. The other hydraulic circuit provides alternative hydraulic inputs to the engine cylinder valve when the normal mechanical input is decoupled. The control for these two hydraulic systems may be essentially mechanical and/or hydraulic as shown in FIG. 5 of the Sickler patent, or it may be essentially electronic as shown in FIG. 7. The two hydraulic circuits may have a common source of hydraulic fluid and they may have other cross-connections, but they are largely separate in operation and they each require a separate hydraulic connection (e.g., 136 and 212 in FIG. 5, or 258 and 212 in FIG. 7) to each cylinder valve operating mechanism.

From the foregoing it will be seen that the known hydraulic modifications of cam control for engine cylinder valves tend to be either relatively limited in extent and purpose (e.g., as in FIG. 16 of the Schechter patent), or tend to require relatively complex hydraulic circuitry (e.g., as in the Sickler patent).

OBJECTS OF THE INVENTION

It is therefore an object of this invention to provide improved and simplified hydraulic circuitry which can be used to more extensively modify the operation of engine cylinder valves in response to engine cams.

It is another object of this invention to provide relatively simple hydraulic circuitry which can be used selectively to partly or completely suppress any engine valve operation associated with the engine cam that otherwise controls that engine valve, for example, switch the engine between positive power mode operation, compression release engine braking mode operation and exhaust gas recirculation mode operation and/or to adjust the timing of engine valve openings for various engine operating conditions.

SUMMARY OF THE INVENTION

These and other objects of the invention are accomplished in accordance with the principles of the invention by providing a hydraulic circuit linkage in the connection between an engine cam and an engine valve associated with that cam. The hydraulic circuit is partly controlled by an electrically operated hydraulic valve (e.g., for selectively relieving hydraulic fluid pressure in the hydraulic circuit). The hydraulic circuit is preferably constructed so that when the electrically operated hydraulic valve relieves hydraulic fluid pressure in that circuit, there is sufficient lost motion between the mechanical input to the circuit and the mechanical output from the circuit to prevent any selected cam function or functions including but not limited to engine braking, compression release retarding, and exhaust gas recirculation from being transmitted to the engine valve associated with that cam. This allows the electrically controlled hydraulic circuit to fully control which cam function (s) the associated engine valve will respond to and which cam function(s) the engine valve will not respond to. In addition, the electrically operated hydraulic circuit can modify the response of the engine valve to various cam functions (e.g., to modify the timing of engine valve responses to those cam functions). In the preferred embodiments only a single hydraulic fluid connection to the mechanism of each valve is needed. Also in the preferred embodiments the ultimate input for all openings of each engine valve comes from a single cam that is associated with that valve.

Further features of the invention, its nature and various advantages will be more apparent from the accompanying drawings and the following detailed description of the preferred embodiments.

BRIEF DESCRIPTION OF THE DRAWINGS

The present invention will now be described in connection with the following figures in which like reference numbers refer to like elements and wherein.

DETAILED DESCRIPTION OF THE PREFERRED EMBODIMENTS

Figure 1:
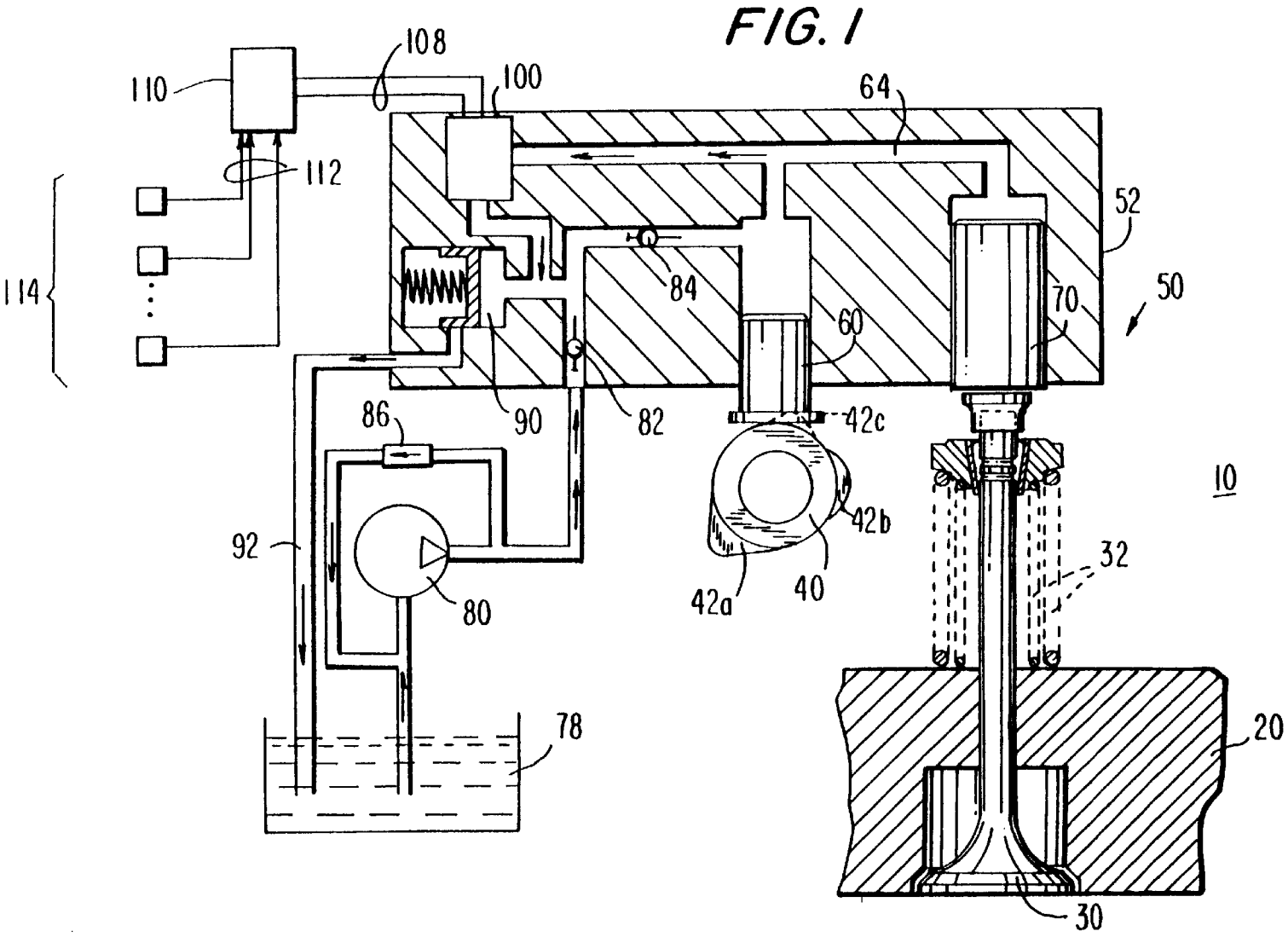
FIG. 1 is a schematic diagram of an internal combustion engine according to an embodiment of the present invention.

An embodiment of an internal combustion engine 10 constructed in accordance with the present invention is illustrated in FIG. 1. The engine 10 includes an engine cylinder head 20 in which at least one engine cylinder valve 30 is movably mounted. The at least one engine cylinder valve 30 controls the flow of gas to and from the cylinders (not shown) of the engine 10. Valve 30, as shown, is an exhaust valve, but it will be understood that valve 30 can alternatively be an intake valve. The at least one valve 30 is resiliently urged toward its upper (closed) position by prestressed compression coil springs 32.

The opening of valve 30 can be produced by lobes such as 42*a*, 42*b* and 42*c* on rotating engine cam 40. Cam 40 may conventionally rotate once for every two revolutions of the engine crankshaft (assuming that the engine is a four-cycle engine). Cam 40 may be synchronized with the engine crankshaft so that cam lobe 42*a* passes master piston 60 (described below) during the exhaust stroke of the engine piston associated with valve 30. Cam lobe 42*a* is therefore the lobe for producing normal exhaust stroke openings of exhaust valve 30 during positive power mode operation of the engine. Cam lobe 42*b* passes master piston 60 near the end of the compression stroke of the engine piston associated with valve 30. Cam lobe 42*b* can therefore be used to produce compression release openings of exhaust valve 30 during compression release engine braking operation of the engine. A third cam lobe 42*c* is provided to open the exhaust valve 30 at predetermined intervals to produce, for example, to modify the compression release opening of the exhaust valve, as described below or to produce an exhaust gas recirculation event, as discussed below. If valve 30 is an intake valve rather than an exhaust valve, then the lobes 42 on the associated cam 40 will have shapes and angular locations different from those shown in FIG. 1, but the underlying operating principles are the same.

Cam 40 is selectively linked to valve 30 by a hydraulic circuit 50 which will now be described. In FIG. 1, a housing 52 in which hydraulic circuit 50 is disposed is fixed and stationary relative to engine cylinder head 20. Hydraulic circuit 50 includes a master piston 60 which is hydraulically coupled to a slave piston 70. Master piston 60 receives a mechanical input from lobes 42*a*, 42*b* and 42*c* on cam 40, and if the hydraulic subcircuit 64 between the master and slave pistons is sufficiently pressurized, that input is hydraulically transmitted to slave piston 70 to cause the slave piston to produce a corresponding mechanical output to open valve 30.

When the engine is operating, a hydraulic fluid pump 80 supplies pressurized hydraulic fluid from sump 78 to subcircuit 64 via check valves 82 and 84. The hydraulic fluid pressure supplied by pump 80 is sufficient to push master piston 60 out into contact with the peripheral surface of cam 40 and to push slave piston 70 into contact with the upper end of the stem of valve 30, but it is not sufficient to cause slave piston 70 to open valve 30. For example, the hydraulic fluid pressure supplied by pump 80 may be approximately 50 to 100 psi. Any over-pressure produced by pump 80 is relieved by relief valve 86, which returns hydraulic fluid to the inlet of pump 80. The hydraulic fluid may be engine lubricating oil, engine fuel, or any other suitable fluid.

Hydraulic fluid accumulator 90 helps keep subcircuit 64 filled with hydraulic fluid of at least approximately the output pressure produced by pump 80. An electrically controlled hydraulic valve 100 is provided for selectively relieving hydraulic fluid pressure (above the output pressure of pump 80) from subcircuit 64. When valve 100 is closed, hydraulic fluid is trapped in subcircuit 64. Subcircuit 64 will then hydraulically transmit a mechanical input from cam 40 and master piston 60 to slave piston 70, thereby causing the slave piston to produce a mechanical output which opens valve 30. On the other hand, when valve 100 is open, hydraulic fluid can escape from subcircuit 64 to accumulator 90. This prevents subcircuit 64 from transmitting an input from cam 40 and master piston 60 to slave piston 70. Valve 30 does not open in response to the cam input when the valve 100 is open. Instead, the motion produced by lobes 42*b* and 42*c* is absorbed so that engine braking or exhaust gas recirculation events are not produced. Preferably valve 100 can vent from subcircuit 64 all the hydraulic fluid flow produced by the longest stroke of master piston 60 that results from any lobe 42 on cam 40. In this way valve 100 can be used to effectively completely cancel or suppress (by means of lost motion in subcircuit 64) any input from cam 40. If accumulator 90 receives too much hydraulic fluid, its plunger moves far enough to the left to momentarily open a drain 92 back to hydraulic fluid sump 78, as shown in FIG. 1.

Valve 100 is controlled by electronic control circuitry 110 associated with engine 10. Control circuit 110 receives various inputs 112 from engine and vehicle instrumentation 114 (which may include inputs initiated by the driver of the vehicle) and produces output signals 108 for appropriately controlling valve 100 (and other similar valves in engine 10). For example, control circuit 110 may control valve 100 differently depending on such factors as the speed of the engine or vehicle, whether the engine is in positive power mode or compression release engine braking mode, etc. The control circuit 110 may include a programmed microprocessor for performing algorithms or look-up table operations to determine output signals 108 appropriate to the inputs 112 that the control circuit is currently receiving. Instrumentation 114 includes engine sensors (e.g., an engine crankangle position sensor) for maintaining basic synchronization between the engine and control circuit 110.

Figure 2A:
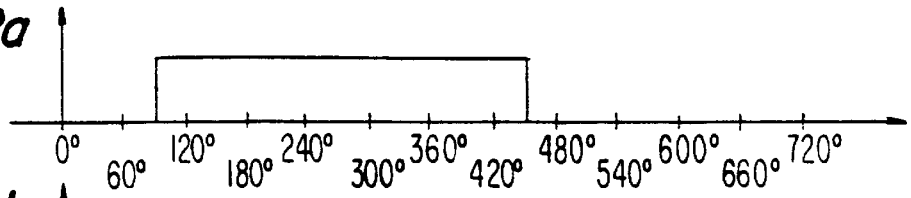
FIG. 2*a* is a simplified diagram of an illustrative signal waveform usable in the apparatus of FIG. 1 or in any of the additional embodiments shown in FIGS. 8–10.
Figure 2B:
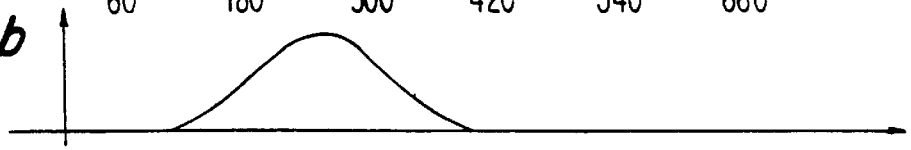
FIG. 2*b* is a simplified diagram of illustrative motion of an engine cylinder valve in the apparatus of FIG. 1 or in any of the additional embodiments shown in FIGS. 8–10.
Figure 2C:
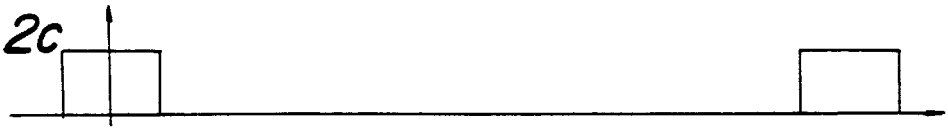
FIGS. 2*c*, 2*e*, 3*a*, 4*a*, 5*a*, 6*a*, 7*a*, 7*c*, 7*e*, and 7*g* are diagrams of the same general kind as FIG. 2*a;*
Figure 2D:
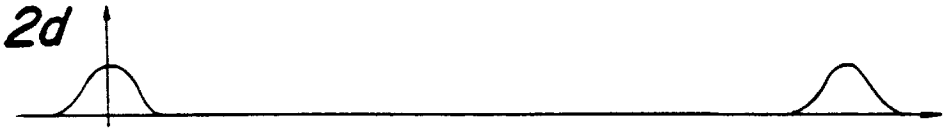
FIGS. 2*d*, 2*f*, 3*b*, 4*b*, 5*b*, 6*b*, 7*b*, 7*d*, 7*f*, and 7*h* are diagrams of the same general kind as FIG. 2*b;*
Figure 2E:
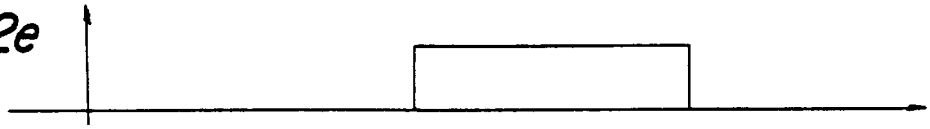

FIGS. 2*a* through 2*f* show illustrative control signals for valves like valve 100 and resulting motions of engine valves like valve 30 under various engine operating conditions. For example, FIG. 2*a* shows the signal 108 from control circuit 110 for controlling the valve 100 associated with the exhaust valve(s) 30 of a typical engine cylinder during positive power mode operation of the engine. In connection with FIG. 2*a*, the valve 100 is closed when the signal trace is high. The numbers along the base line in FIG. 2*a* are engine crankangle degrees and apply to FIGS. 2*b* through 2*f*. FIG. 2*c* shows the corresponding signal 108 during compression release engine braking operation of the engine. FIG. 2*e* shows the signal 108 from control circuit 110 for controlling the valve 100 associated with the intake valve(s) 30 of the same engine cylinder with which FIGS. 2*a* and 2*c* are associated. In this example, FIG. 2*e* is the same for both positive power and compression release engine braking mode operation of the engine.

Figure 2F:
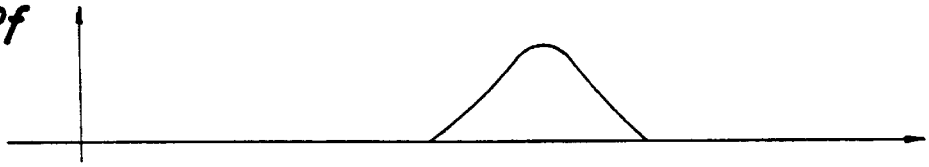

As shown in FIGS. 2*a* and 2*b*, because the valve 100 associated with the hydraulic subcircuit 64 for the exhaust valve is closed when the exhaust lobe 42*a* on cam 40 passes master piston 60, that lobe may cause exhaust valve 30 to be open as shown in FIG. 2*b* during the exhaust stroke of the associated engine cylinder (i.e., between engine crankangles 90° and 420°). This is the motion of exhaust valve 30 that is appropriate for positive power mode operation of the engine. FIG. 2*a* shows that valve 100 is open when compression release lobe 42*b* on cam 40 passes master piston 60 (near engine crankangle 0° or 720°). Exhaust valve 30 therefore does not open in response to lobe 42*b*. On the other hand, FIGS. 2*c* and 2*d* show valve 100 being closed near top dead center of each compression stroke of the engine cylinder (engine crankangle 0° or 720°) but open during the exhaust stroke of that cylinder (crank angle 90° to 420°. This causes exhaust valve 30 to open as shown in FIG. 2*d* in response to compression release lobe 42*b* passing master piston 60, but it allows exhaust valve 30 to remain closed as exhaust lobe 42*a* passes master piston 60. FIGS. 2*e* and 2*f* show that the valve 100 associated with the intake valve of the engine cylinder is closed during the intake stroke of the engine cylinder (between engine crankangles 360° and 540°). This causes the intake valve 30 of that cylinder to open as shown in FIG. 2*f* in response to an intake lobe on an intake valve control cam 40 associated with that engine cylinder. In this embodiment the operation of the intake valve remains the same for positive power mode and compression release engine braking mode operation of the engine.

Figure 3A:
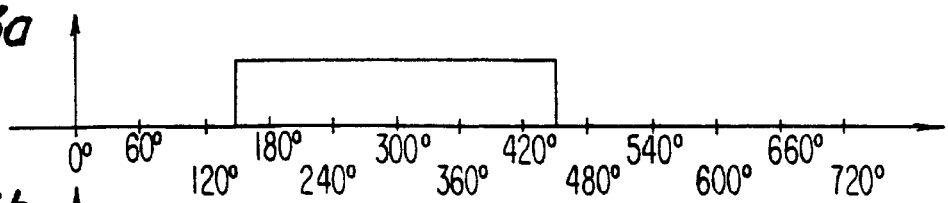
Figure 3B:
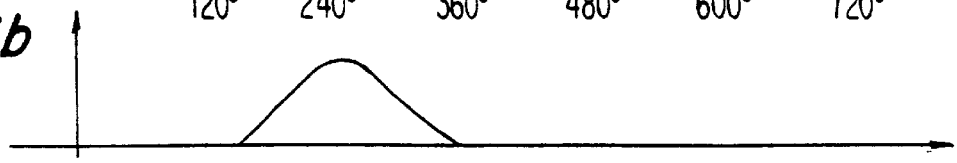

Additionally or alternatively to allowing selection of which cam lobes 42 the engine valves 30 will respond to, the apparatus of this invention allows the response of the engine valves 30 to any cam lobe to be varied if desired. For example, FIGS. 3*a* and 3*b* are respectively similar to FIGS. 2*a* and 2*b*, but show that if control circuit 110 delays the closing of valve 100 somewhat (as compared to FIG. 2*a*), valve 30 begins to open somewhat later. In other words, the first part of exhaust lobe 42*a* is suppressed or ignored. In addition, because some hydraulic fluid is allowed to escape from subcircuit 64 during the initial part of exhaust lobe 42*a*, valve 30 does not open as far in FIG. 3*b* as it does in FIG. 2*b*, and valve 30 closes sooner in FIG. 3*b* than in FIG. 2b. The principles illustrated by FIGS. 3*a* and 3*b* are equally applicable to any of the other types of valve motion shown in the FIG. 2 group.

Figure 4A:
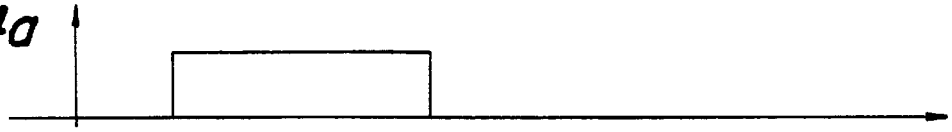
Figure 4B:
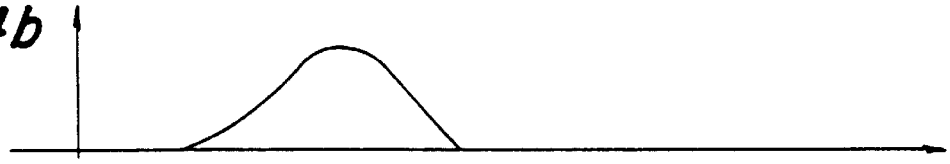

FIGS. 4*a* and 4*b* show another example of using valve 100 to modify the response of engine valve 30 to cam lobe 42*a*. Again, FIGS. 4*a* and 4*b* are respectively similar to FIGS. 2*a* and 2*b*, but show control circuit 110 re-opening valve 100 sooner than is shown in FIGS. 2*a*. As shown in FIG. 4*b* this causes engine valve 30 to re-close sooner than in FIG. 2*b*. Re-opening valve 100 before the final portion of cam lobe 42*a* has passed master piston 60 causes valve 30 to ignore that final portion of the cam lobe, thereby allowing valve 30 to re-close sooner than it would under full control of the cam. Again, the principles illustrated by FIGS. 4a and 4b are equally applicable to any of the other types of valve motion shown in the FIG. 2 or FIG. 3 groups.

Figure 5A:
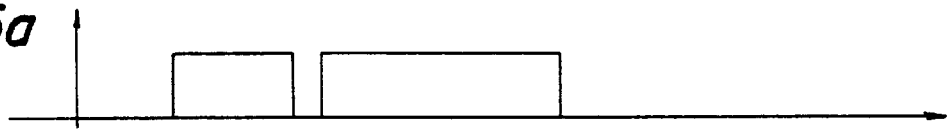
Figure 5B:
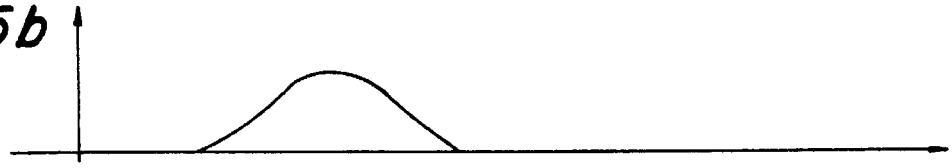

FIGS. 5*a* and 5*b* show yet another example of using valve 100 to modify the response of engine valve 30 to cam lobe 42*a*. Again FIGS. 5*a* and 5*b* are respectively similar to FIGS. 2*a* and 2*b*. FIG. 5*a* shows control circuit 110 opening the associated valve 100 briefly as exhaust lobe 42*a* approaches its peak. This allows some hydraulic fluid to escape from subcircuit 64, thereby preventing valve 30 from opening quite as far as in FIG. 2*b*. As another consequence, valve 30 re-closes somewhat earlier than in FIG. 2*b*.

Figure 6A:
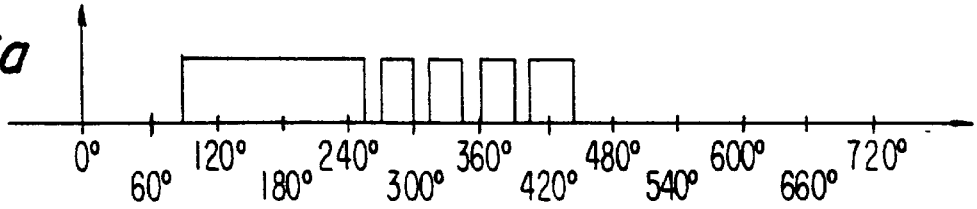
Figure 6B:
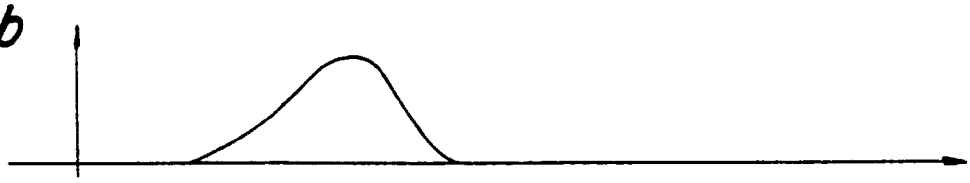

Another example of modulation of valve 100 of the general type shown in FIG. 5*a* is illustrated by FIGS. 6*a* and 6*b*. Once again, FIGS. 6*a* and 6*b* are respectively similar to FIGS. 2*a* and 2*b*, except that during the latter portion of exhaust lobe 42*a* control circuit 110 begins to rapidly open and close valve 100. This enables some hydraulic fluid to escape from subcircuit 64, which accelerates the closing of valve 30, although the valve 30 closing still remains partly under the control of exhaust lobe 42*a*. The principles illustrated by FIGS. 5*a* through 6b are equally applicable to any of the other types of valve motion shown in the FIG. 2, FIG. 3, or FIG. 4 groups. Moreover, valve modulation of the type shown in FIG. 6*a* and with any desired duty cycle (ratio of valve open time to valve close time) can be used at any time during a cam lobe to provide any of a wide range of modifications of the response of the associated engine valve to the cam lobe.

Figures 7A, 7B, 7C, 7D, 7E, 7F, 7G, 7H:
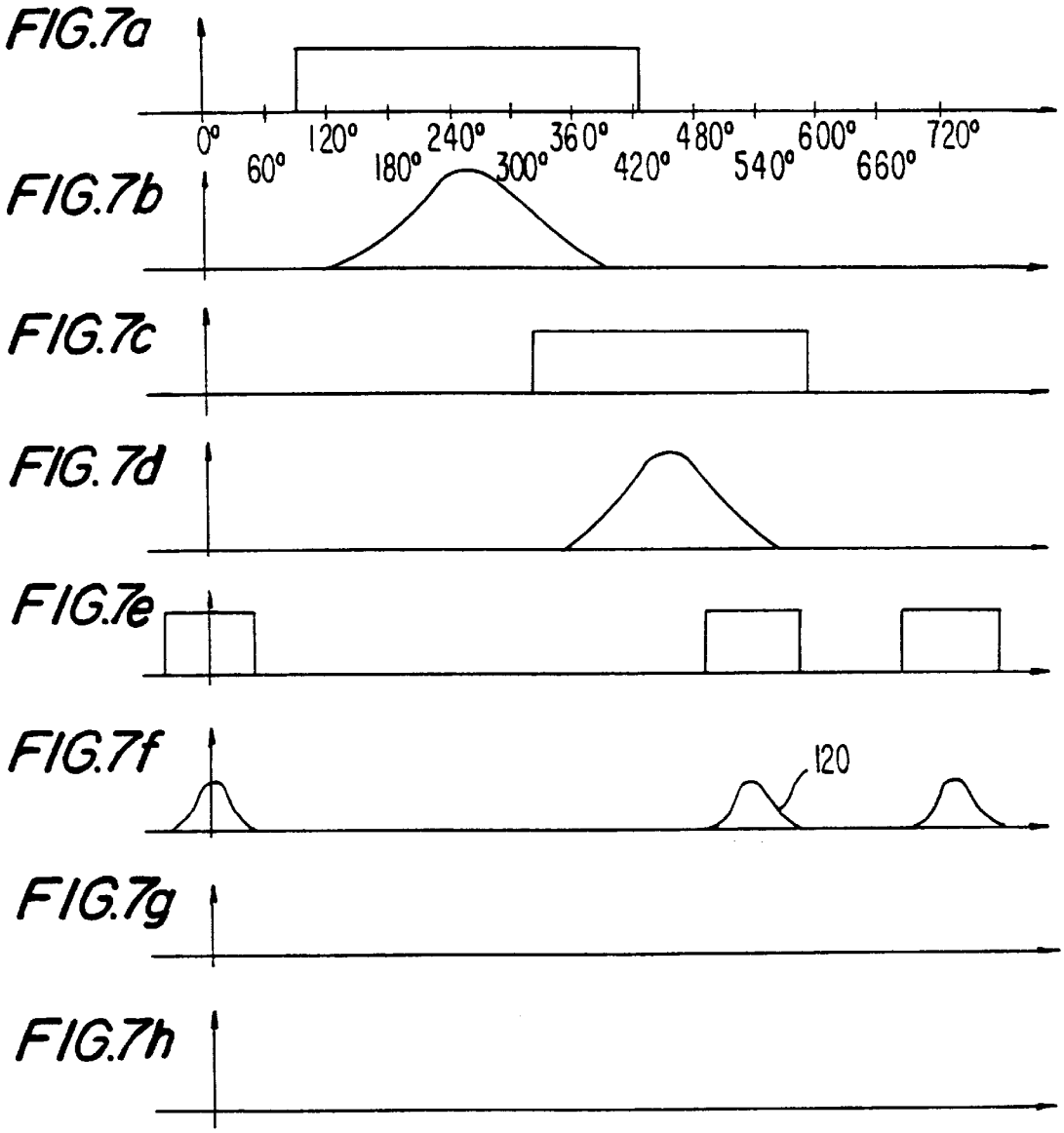

FIGS. 7*a* through 7*h* illustrate how the present invention can be used to cause engine 10 to operate in another way during compression release engine braking. FIGS. 7*a* through 7*d* are respectively similar to FIGS. 2*a*, 2*b*, 2*e*, and 2*f* and show the same positive power mode operation of the engine as is shown in the FIG. 2 group. FIG. 7*e* shows control of the valve 100 associated with the exhaust valve(s) during compression release engine braking, and FIG. 7*g* shows control of the valve 100 associated with the intake valve(s) during compression release engine braking. FIGS. 7*f* and 7*h* show exhaust and intake valve motion, respectively, during compression release engine braking. In order to produce additional exhaust valve openings 120 in FIG. 7*f*, an additional lobe 42*c* (FIG. 1) is provided on cam 40. As shown in FIG. 7*e*, during compression release engine braking the valve 100 associated with the exhaust valve(s) is opened throughout the normal exhaust stroke of the engine to suppress the normal exhaust valve opening. However, this valve 100 is closed near the end of the expansion stroke (near engine crankangle 540°) and again near the end of the compression stroke (near engine crankangle 0° or 720°). This causes exhaust valve 30 to open (as at 120) in response to cam lobe 40*c* near the end of the expansion stroke (to charge the engine cylinder with a reverse flow of gas from the exhaust manifold of the engine). Exhaust valve 30 opens again in response to cam lobe 42*b* near the end of the compression stroke (to produce a compression release event for compression release engine braking). FIGS. 7*g* and 7*h* show that the associated intake valve 30 is not opened at all during this type of compression release engine braking operation.

The type of compression release engine braking operation shown in FIGS. 7*e* through 7*h* may be especially advantageous when the engine is equipped with an exhaust brake for substantially closing the exhaust system of the engine when engine retarding is desired. This increases the pressure in the exhaust manifold of the engine, making it possible to supercharge the engine cylinder when exhaust valve opening 120 occurs. This supercharge increases the work the engine must do during the compression stroke, thereby increasing the compression release retarding the engine can produce.

FIGS. 2*a* through 7*h* show that the present invention can be used to modify the responses of the engine valves to the engine cam lobes in may different ways. These include complete omission of certain cam lobes at certain times, or more subtle alteration of the timing or extent of engine valve motion in response to a cam lobe. These modifications may be made to change the mode of operation of the engine (e.g., from positive power mode to compression release engine braking mode or vice versa) or to optimize the performance of the engine for various engine or vehicle operation conditions (e.g., changes in engine or vehicle speed) as sensed by engine or vehicle instrumentation 114.

The present invention may be used to produce an exhaust gas recirculation event. Exhaust gas recirculation may be accomplished using lobe 42*c* or other suitable lobes on cam 40. When exhaust gas recirculation is desired, the valve 100 is closed such that the subcircuit 64 is fully charged such that the motion of the master piston 60 is transferred to slave piston 70 to open valve 30 to effectuate exhaust gas recirculation. The valve 100 may be operated, as discussed above, to control the timing and duration of the exhaust gas recirculation event. For example, the valve 100 may be held open to delay the start of the exhaust gas recirculation event. Similarly, the valve 100 may be opened during the exhaust gas recirculation event to absorb some of the motion derived from the lobe 42*c* to shorten the exhaust gas recirculation event. It is contemplated by the present invention that the valve 100 can be operated to modify the exhaust gas recirculation event.

Figure 8:
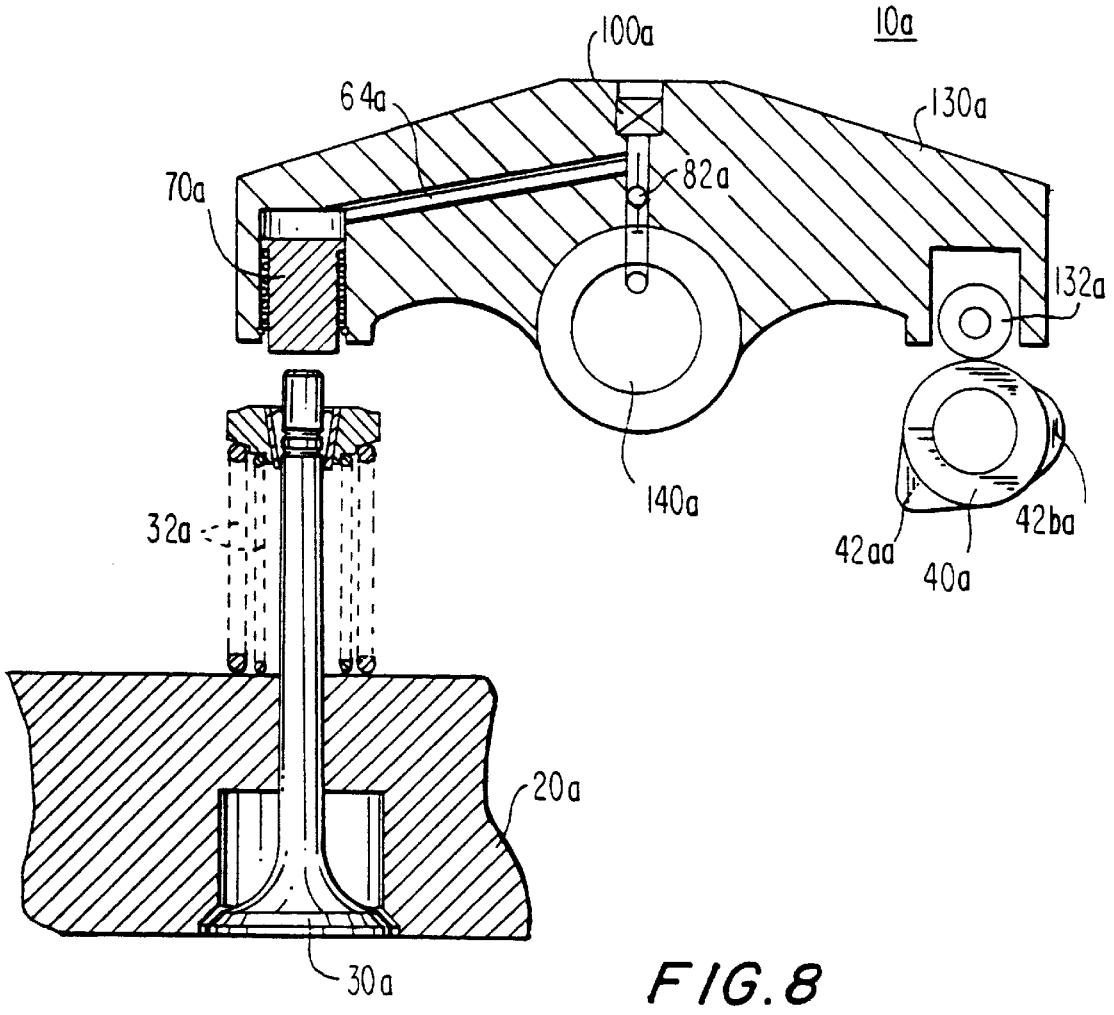
FIG. 8 is a diagram similar to FIG. 1 showing another embodiment of the invention.

FIG. 8 shows another embodiment of the invention in which the electrically controlled hydraulic circuitry of this invention is partly built into the overhead rockers of engine 10*a*. (To the extent that components in FIG. 8 are related to components in FIG. 1, the same reference numbers are used again in FIG. 8, but with a suffix letter "a". Substantially new elements in FIG. 8 have previously unused reference numbers, but again a suffix letter "a" is added for uniformity of references to FIG. 8.)

As shown in FIG. 8, representative rocker 130*a* is rotatably mounted on rocker shaft 140*a*. The right-hand portion of rocker 130*a* (as viewed in FIG. 8) carries a rotatable cam follower roller 132*a* which bears on the peripheral cam surface of rotating cam 40*a*. Hydraulic subcircuit 64*a* extends from a source of pressurized hydraulic fluid (which is mounted for reciprocation in the left-hand portion of rocker 130*a*). The ultimate source of the pressurized hydraulic fluid in shaft 140*a* may be a pump arrangement similar to elements 78, 80, and 86 in FIG. 1. Electrically controlled hydraulic valve 100*a* can selectively release hydraulic fluid from subcircuit 64*a* out over the top of rocker 130*a*. Valve 100*a* is controlled by control circuitry similar to element 110 in FIG. 1.

The apparatus of FIG. 8 can be made to operate in a manner similar to that described above for FIG. 1. The pressure of the hydraulic fluid supply is great enough to push slave piston 70*a* out into contact with the upper end of engine valve 30*a*. However, this pressure is not great enough to open valve 30*a* against the valve-closing force of springs 32*a*. If valve 100*a* is closed when a cam lobe 42*aa* or 42*ba* passes roller 132*a*, the hydraulic fluid trapped in subcircuit 64*a* causes slave piston 70*a* to open valve 30*a*. On the other hand, if valve 100*a* is open when a cam lobe 42*aa* or 42*ab* passes roller 132*a*, slave piston 70*a* will move into rocker 130*a*, thereby expelling some hydraulic fluid from subcircuit 64*a* and allowing valve 30*a* to remain closed despite the passage of a cam lobe 42. Any of the techniques for modifying engine valve response to cam lobes that are illustrated by FIGS. 2*a* through 7*h* are equally applicable to the embodiment shown in FIG. 8. Thus it is again preferred that the lost motion available in hydraulic subcircuit 64*a* is sufficient to allow any lobe on cam 40*a* to be completely ignored. More subtle modifications of the timing and/or extent of engine valve response to cam lobes are also possible as is discussed above in connection with FIGS. 2*a* through 7*h*.

Figure 9:
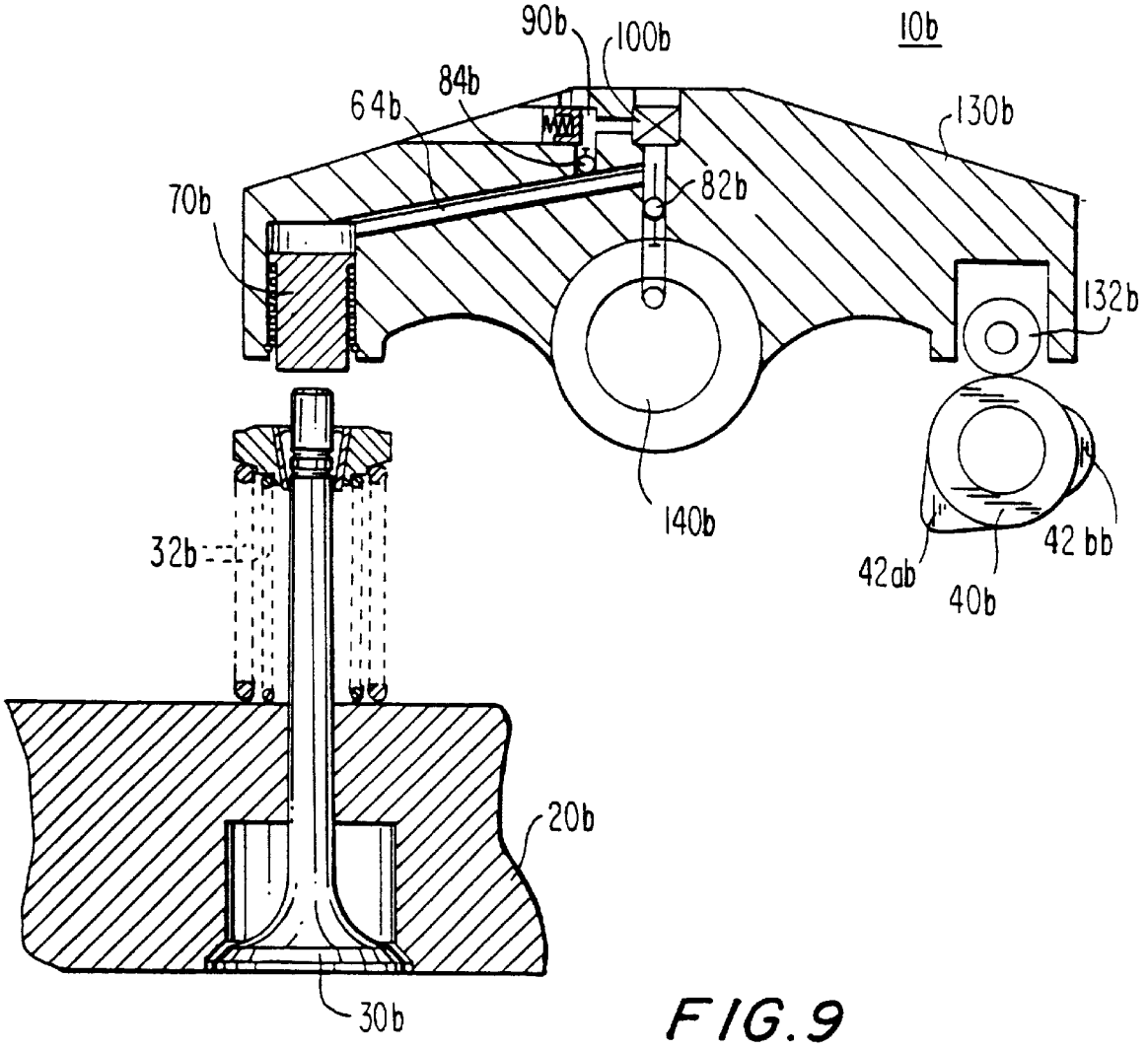
FIG. 9 is another diagram similar to FIG. 1 showing another embodiment of the invention.

FIG. 9 shows another embodiment of the present invention which includes an accumulator 90*b* and check valve 84*b*, respectively similar to accumulator 90 and check valve 84 in FIG. 1. Elements in FIG. 9 that are similar to elements in FIG. 8 have the same reference numbers, but with the suffix letter "b" rather than "a" as in FIG. 8. When valve 100*b* is open, it releases hydraulic fluid from subcircuit 64*b* to accumulator 90*b* in a manner similar to the embodiment shown in FIG. 1. In other respects the operation of the FIG. 9 embodiment is similar to operation of the embodiment shown in FIG. 8, and thus it will not be necessary to repeat the explanation of FIG. 8 for FIG. 9.

Figure 10:
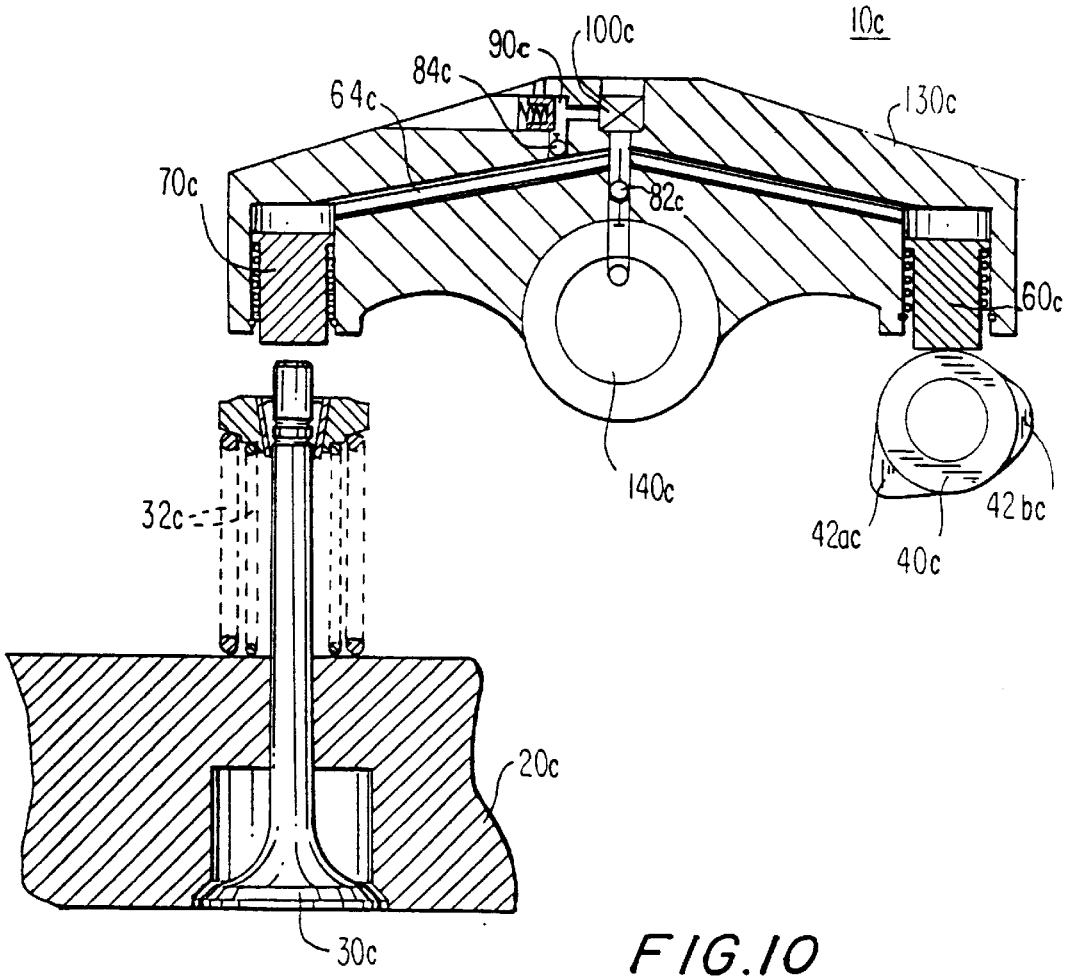
FIG. 10 is yet another diagram similar to FIG. 1 showing yet another embodiment of the invention.

FIG. 10 shows yet another embodiment which is similar to the embodiment shown in FIG. 9 but with the addition of master piston 60*c* (similar to master piston 60 in FIG.1) to hydraulic subcircuit 64*c*. Elements in FIG. 10 which are similar to elements in FIG. 9 have the same reference numbers, but with the suffix letter "c" rather than "b" as in FIG. 9. The operation of this embodiment is similar to that of the embodiment shown in FIG. 9, so it will not be necessary to repeat the explanation of FIG. 9 for FIG. 10.

It will be understood that the foregoing is only illustrative of the principles of the invention, and that various modifications can be made by those skilled in the art without departing from the scope and spirit of the invention. For example, while FIGS. 1 and 8–10 suggest that there is one exhaust or intake valve 30 per engine cylinder, it is quite common to provide two valves of each type in cylinder. The apparatus of this invention can be readily modified to control multiple intake or exhaust valves per cylinder.

What is claimed is:

1. A internal combustion engine valve operating system comprising:

at least one rocker arm having an internal hydraulic circuit charged with hydraulic fluid;

at least one engine valve in operative contact with said rocker arm;

means for imparting a compression-release motion and an exhaust gas recirculation motion to said rocker arm; and means for selectively losing the compression-release motion, said means for selectively losing comprising:

a recess provided in an end of the rocker arm, said recess being charged with hydraulic fluid from the internal hydraulic circuit in the rocker arm;

a slave piston slideably disposed to extend out of the rocker arm recess under the influence of the hydraulic fluid in the rocker arm recess; and a control valve in hydraulic communication with the internal hydraulic circuit, said control valve being adapted to selectively release hydraulic fluid from the internal hydraulic circuit.

2. A system for controlling the actuation of an internal combustion engine valve, said system comprising:

an engine cam;

an engine rocker arm shaft including an internal hydraulic passage;

an engine rocker arm mounted on the shaft; said rocker arm having a first end in operative contact with the cam, a slave piston recess in a second end, and an opening at an outer surface;

a slave piston slideably disposed in the slave piston recess;

a hydraulic control valve disposed in the rocker arm outer surface opening, said control valve being adapted to open and close at least once per cycle of the cam; and a hydraulic subcircuit provided in the rocker arm; said subcircuit providing selective hydraulic communication between the shaft internal passage, the control valve, and the slave piston recess.

3. The system of claim 2 further comprising:

a master piston recess in said rocker arm first end;

a master piston slideably disposed in the master piston recess, and wherein said hydraulic subcircuit provides selective hydraulic communication between the shaft internal passage, the control valve, the slave piston recess, and the master piston recess.

4. The system of claim 3 further comprising:

means for biasing the slave piston into the slave piston recess; and means for biasing the master piston into the master piston recess.

5. The system of claim 3 further comprising an accumulator in selective hydraulic communication with the control valve and the hydraulic subcircuit.

6. The system of claim 2 further comprising means for biasing the slave piston into the slave piston recess.

7. The system of claim 2 further comprising a check valve provided in the hydraulic subcircuit in a position adapted to prohibit back flow of hydraulic fluid from the control valve and the slave piston recess to the shaft internal passage.

8. The system of claim 2 further comprising an accumulator in selective hydraulic communication with the control valve and the hydraulic subcircuit.

9. The system of claim 8 further comprising a second check valve provided in the hydraulic subcircuit adapted to prohibit backflow of hydraulic fluid from the slave piston recess to the accumulator.

10. The system of claim 2 wherein said control valve is adapted to selectively lose all of the engine valve motion provided by a compression-release lobe on the cam.

11. The system of claim 2 wherein said control valve is adapted to selectively lose a portion of the engine valve motion provided by a compression-release lobe on the cam.

12. The system of claim 2 wherein said control valve is adapted to selectively lose all or a portion of the engine valve motion provided by a main exhaust lobe on the cam.

13. The system of claim 2 wherein said control valve is adapted to selectively lose all or a portion of the engine valve motion provided by ally lobe on the cam.

14. A system for controlling the actuation of an internal combustion engine valve, said system comprising:

an engine cam;

an engine rocker arm shaft including an internal hydraulic passage;

an engine rocker arm mounted on the shaft; said rocker arm having a first end in operative contact with the cam, a slave piston recess in a second end, and an opening at an outer surface;

a slave piston slideably disposed in the slave piston recess;

a accumulator disposed in the rocker arm;

a hydraulic control valve disposed in the rocker arm outer surface opening, said control valve being adapted to release hydraulic fluid to the accumulator; and a hydraulic subcircuit provided in the rocker arm, said subcircuit providing selective hydraulic communication between the shaft internal passage, the control valve, the accumulator, and the slave piston recess.

15. The system of claim 14 further comprising:

a master piston recess in said rocker arm first end;

a master piston slideably disposed in the master piston recess, and wherein said hydraulic subcircuit provides selective hydraulic communication between the shaft internal passage, the control valve, the slave piston recess, and the master piston recess.

16. The system of claim 15 further comprising:

means for biasing the slave piston into the slave piston recess; and means for biasing the master piston into the master piston recess.

17. The system of claim 16 further comprising a check valve provided in the hydraulic subcircuit adapted to prohibit back flow of hydraulic fluid from the control valve and the slave piston recess to the shaft internal passage.

18. The system of claim 17 further comprising a second check valve provided in the hydraulic subcircuit adapted to prohibit backflow of hydraulic fluid from the slave piston recess to the accumulator.

19. The system of claim 14 wherein said control valve is adapted to selectively lose all of the engine valve motion provided by a compression-release lobe on the cam.

20. The system of claim 14 wherein said control valve is adapted to selectively lose a portion of the engine valve motion provided by a compression-release lobe on the cam.

21. The system of claim 14 wherein said control valve is adapted to selectively lose all or a portion of the engine valve motion provided by a main exhaust lobe on the cam.

22. The system claim 14 wherein said control valve is adapted to selectively lose all or a portion of the engine valve motion provided by any lobe on the cam.

* * * * *